US005960544A

United States Patent [19]

Beyers

[11] Patent Number: 5,960,544

[45] **Date of Patent: *Oct. 5, 1999**

[54] DOUBLE-ENDED DUAL MECHANISM RETRACTABLE BLADE UTILITY KNIFE

[76] Inventor: Greg L. Beyers, 2215 W. 3rd, Lot #36, Bloomington, Ind. 47401

[ * ] Notice: This patent issued on a continued prosecution application filed under 37 CFR 1.53(d), and is subject to the twenty year patent term provisions of 35 U.S.C. 154(a)(2).

[21] Appl. No.: 08/626,824

[22] Filed: Apr. 3, 1996

[51] Int. Cl.[6] ..... B25F 11/00

[52] U.S. Cl. ..... 30/125; 30/162; 30/335; 30/299

[58] Field of Search ..... 30/125, 162, 163, 30/335, 336, 299, 304, 305

[56] References Cited

U.S. PATENT DOCUMENTS

| | | | |
|---|---|---|---|
| 1,493,620 | 5/1924 | Evers | 30/162 X |
| 2,145,985 | 2/1939 | Krajicek | 30/162 X |
| 2,736,960 | 3/1956 | Armstrong | 30/162 |
| 3,577,637 | 5/1971 | Braginetz | 30/162 |
| 3,660,896 | 5/1972 | Umholtz | 30/162 |
| 3,708,881 | 1/1973 | Bennett | 30/335 X |
| 3,816,918 | 6/1974 | Brunty | 30/305 X |
| 4,578,865 | 4/1986 | Keller | 30/304 |
| 4,586,256 | 5/1986 | Weimann | 30/162 |
| 4,744,146 | 5/1988 | Schmidt | 30/125 X |
| 4,953,293 | 9/1990 | Sterlacci | 30/162 X |
| 5,023,996 | 6/1991 | Pape et al. | 30/125 X |
| 5,093,994 | 3/1992 | Karas | 30/162 X |
| 5,214,852 | 6/1993 | Napolitano | 30/125 |
| 5,230,152 | 7/1993 | Kennedy | 30/162 |
| 5,282,316 | 2/1994 | Anderson | 30/125 X |
| 5,337,481 | 8/1994 | Mears | 30/335 X |
| 5,511,261 | 4/1996 | Collins | 30/162 X |
| 5,613,300 | 3/1997 | Schmidt | 30/335 X |
| 5,644,843 | 7/1997 | Young | 30/335 X |

*Primary Examiner*—M. Rachuba

*Attorney, Agent, or Firm*—Woodard, Emhardt, Naughton, Moriarty & McNett

[57] ABSTRACT

A double-ended dual mechanism retractable blade utility knife. The knife includes two separately actuable mechanisms which allow extension and retraction of one or both blades independently of one another. The cutting surfaces of the respective blades are oriented towards opposite sides of the knife, thereby facilitating rotation of the knife within the user's hand in order to change which blade is currently being used. The independent nature of the dual mechanisms allows both of the blades to be held in the extended position. A storage area is further provided behind each of the mechanisms for the storage of spare blades.

7 Claims, 2 Drawing Sheets

DOUBLE-ENDED DUAL MECHANISM RETRACTABLE BLADE UTILITY KNIFE

TECHNICAL FIELD OF THE INVENTION

The present invention generally relates to utility knives and, more particularly, to a double-ended dual-mechanism retractable blade utility knife.

BACKGROUND OF THE INVENTION

Utility knives which incorporate a retractable, replaceable razor blade have been popular in many applications for years. There are deficiencies, however, in the prior art designs which limit their usefulness in certain applications. For example, in the roofing trade it is generally necessary for the roofer to carry two such utility knives. One knife is equipped with a straight razor blade for cutting felt paper and the like, while the other knife is equipped with a hooked blade for cutting shingles and the like which have a granulated surface. Neither of these knives are well adapted for cutting the other type of material, therefore it is necessary for the roofer to carry both types of knives.

Carrying two knives, however, is inconvenient, especially when working on a roof. Whenever it is necessary to switch knives, the user must retract the first blade and stow the first knife, take out the second knife and extend the second blade. This is extremely inconvenient during applications where use of both knives in alternating succession is routinely required.

There have been attempts in the prior art to solve this problem. For example, U.S. Pat. No. 5,093,994 to Karas discloses a double-ended utility knife. This knife, however, still exhibits most of the problems encountered with using two separate knives. To switch blades, the knife must be turned around, the first blade must be retracted and the second blade must be extended. Turning the knife around is generally a two-handed operation.

There is therefore a need in the prior art for a utility knife that allows use of two different blades without requiring the cumbersome manipulations required by prior art knives during blade changes. The present invention is directed toward meeting this need.

SUMMARY OF THE INVENTION

The present invention relates to a double-ended dual-mechanism retractable blade utility knife. The knife includes two separately actuable mechanisms which allow extension and retraction of one or both blades independently of one another. The cutting surfaces of the respective blades are oriented towards opposite sides of the knife, thereby facilitating rotation of the knife within the user's hand in order to change which blade is currently being used. The independent nature of the dual mechanisms allows both of the blades to be held in the extended position. A storage area is further provided behind each of the mechanisms for the storage of spare blades.

In one form of the invention, a double-ended dual-mechanism retractable blade utility knife is disclosed, comprising a housing; a first blade carrier operative to carry a first blade and to slide along a longitudinal axis of the housing; and a second blade carrier operative to carry a second blade and to slide along the longitudinal axis of the housing; wherein the first and second blade carriers may be slid along the longitudinal axis of the housing independently of one another.

In another form of the invention, a double-sided dual-mechanism retractable blade utility knife is disclosed, comprising a housing; a first blade carrier operative to carry a first blade and to slide along a longitudinal axis of the housing; a first space formed in the housing adjacent the first blade carrier, the first space sized to allow storage of first spare blades; a second blade carrier operative to carry a second blade and to slide along the longitudinal axis of the housing; and a second space formed in the housing adjacent the second blade carrier, the second space sized to allow storage of second spare blades; wherein the first and second blade carriers may be slid along the longitudinal axis of the housing independently of one another; and wherein a first cutting surface of the first blade is positioned on a first side of the longitudinal axis; and wherein a second cutting surface of the second blade is positioned on a second side of the longitudinal axis.

DETAILED DESCRIPTION OF THE PREFERRED EMBODIMENTS

Figure 1:
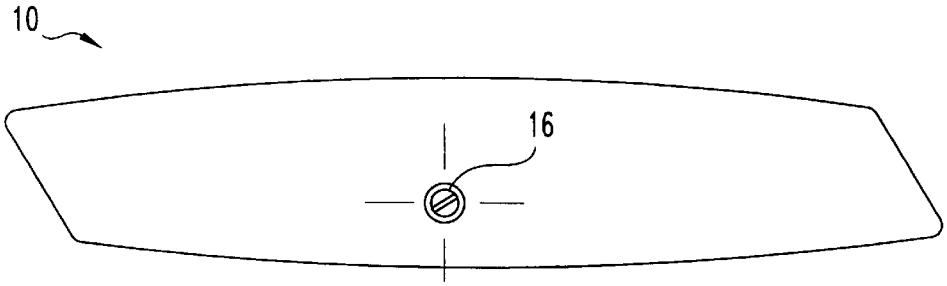
FIG. 1 is a side elevational view of an exterior of the utility knife of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIG. 1, there is illustrated a first embodiment of the present invention, indicated generally at 10.

The two ends of the utility knife 10 are identical, with one end being inverted about the longitudinal knife axis with respect to the other end. Therefore, identical reference numbers are used herein to denote identical parts, with the suffix "a" or "b" added to denote on which end of the knife 10 the part is located.

Figure 2A:
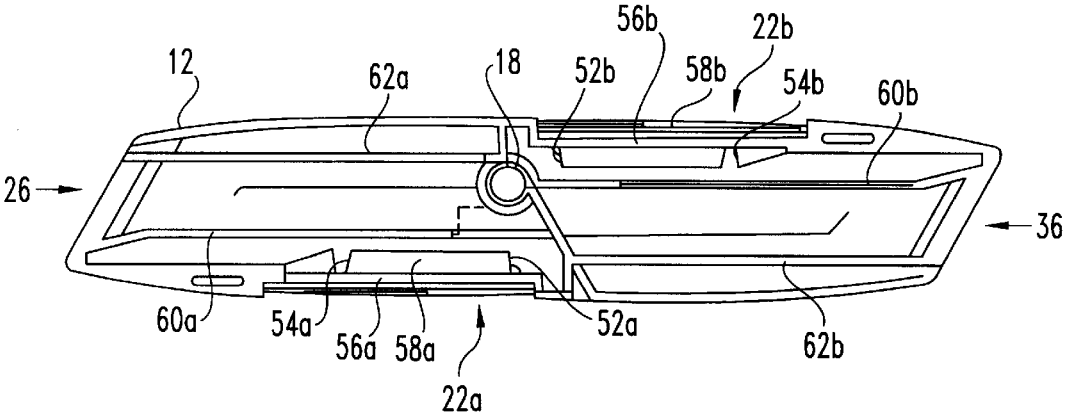
FIG. 2A is a side elevational view of an interior of one half of the knife of FIG. 1.
Figure 2B:
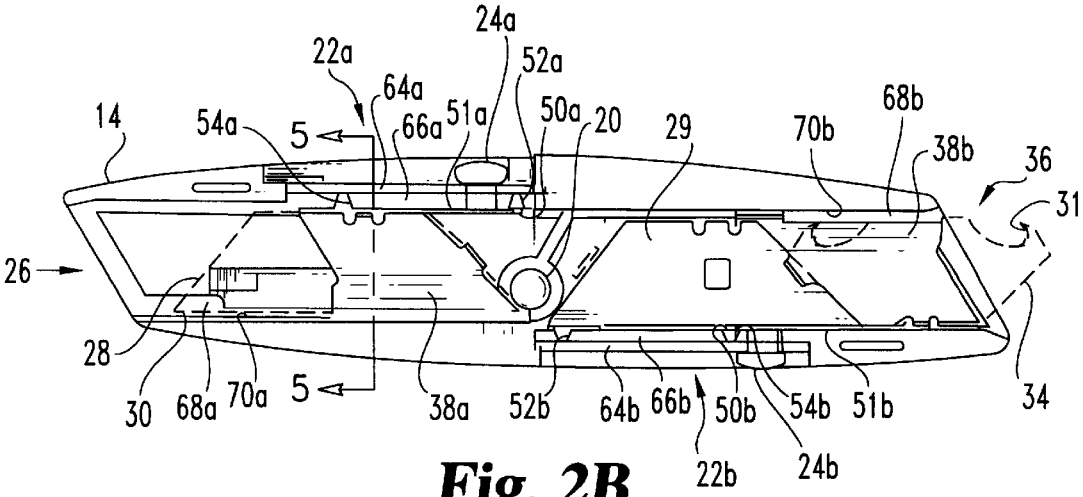
FIG. 2B is a side elevational view of an interior of a second half of the knife of FIG. 1, illustrating the actuation mechanisms.

With reference to FIGS. 2A–B, the utility knife 10 includes two mating housing halves 12 and 14 which are held together by a transverse threaded fastener 16 which passes through the hole 18 and threadably engages the hole 20 which is formed as a portion of the housing half 14. The two housing halves 12, 14 form a first open channel 22*a* in which is located a first actuating lever 24*a*. Movement of the first actuating lever 24*a* to the left in FIG. 2B causes a first blade (illustrated in phantom at 28) to be extended from a slot formed in the first end 26 of the utility knife 10. The first blade 28 includes a first cutting surface 30 facing downward in FIG. 2*b*. Conversely, movement of the first actuating lever 24*a* to the right in FIG. 2B causes the first blade 28 to be retracted completely within the housing 10. Similarly, a second open channel 22*b* is formed by the mating housing halves 12, 14 transversely and longitudinally opposite from the open channel 22*a*. A second actuating lever 24*b* is disposed within the second open channel 22*b* and is operative to extend a second blade (illustrated in phantom at 34) from an open slot in a second end 36 of the utility knife 10 when the second actuating lever 24*b* is moved to the right in FIG. 2B. The second blade 34 includes a second cutting surface 31 facing upward in FIG. 2*b*. Movement of the second actuating lever 24*b* to the left in FIG. 2B operates to retract the second blade 34 completely within the utility knife 10.

Figure 3:
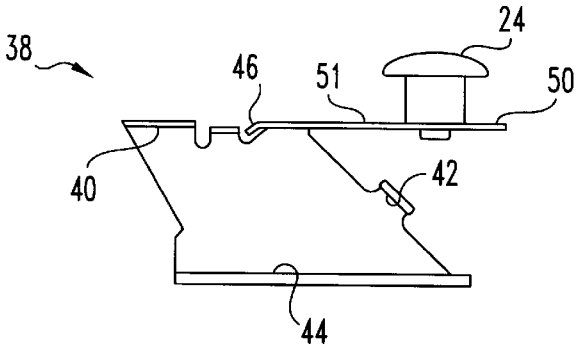
FIG. 3 is a side elevational view of a blade carrier of the present invention.
Figure 4:
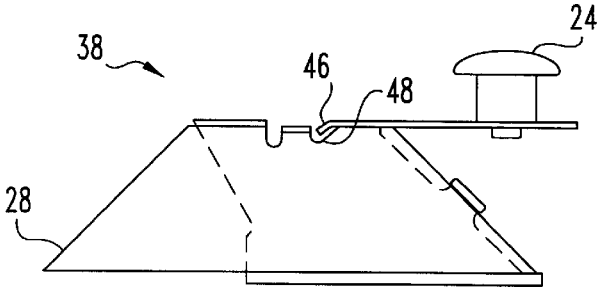
FIG. 4 is a side elevational view of the blade carrier of FIG. 3 with a straight razor blade mounted thereon.

Each of the actuating levers 24*a* and 24*b* is attached to respective first and second blade carriers 38*a* and 38*b*, as illustrated in FIG. 28. Because the configuration of first blade carrier 38*a* is identical to the configuration of second blade carrier 38*b*, such configuration is illustrated in FIGS. 3 and 4 without the use of "a" and "b" suffixes. For example, reference to blade carrier 38 in FIGS. 3 and 4 should be understood to apply to both first blade carrier 38*a* and second blade carrier 38*b*. An analogous numbering scheme is used to refer to the elements in FIG. 5 that are common to both the first and second sides of the knife 10. Referring now to FIGS. 3 and 4, the blade carrier 38 is preferably formed from metal and includes raised transverse surfaces 40, 42 and 44 which operate to limit movement in three directions of a blade 28 mounted thereon (see FIG. 4). Movement of the blade 28 is further prevented by a tab 46 which fits into a notch 48 formed into the blade 28. The blade 28 has two such notches 48 which allow for reversing of the blade 28 within the blade carrier 38 for extended blade life. The blade 28 is of the type standardly used in this art.

Referring once again to FIGS. 2A–B, the first blade carrier 38*a* is maintained in a retracted position by engagement of a first tab formed on the first end 50*a* of the first blade carrier 38*a* with a first indentation 52*a* formed in the housing halves 12, 14. Similarly, the first blade carrier 38*a* is maintained in an extended position by interaction between the first tab formed on the first end 50*a* and a second indentation 54*a* notch 54 formed in the housing halves 12, 14. The first tab formed on the first end 50*a* of the first blade carrier 38*a* is moved from first indentation 52*a* to second indentation 54*a* (and vice versa) by depressing the first actuating lever 24*a*, which causes the first arm 51*a* to flex, thereby disengaging the first tab formed on the first end 50*a* from the first and second indentations 52*a*, 54*a*. Engagement of the first tab formed on the first end 50*a* with the first and second indentations 52*a* and 54*a* therefore operates to securely maintain the first blade carrier 38*a* (and hence the first blade 28) in either the retracted or extended position.

The second blade carrier 38*b* is maintained in a retracted position by engagement of a second tab formed on the second end 50*b* of the second blade carrier 38*b* with a third indentation 52*b* formed in the housing halves 12, 14. Similarly, the second blade carrier 38*b* is maintained in an extended position by interaction between the second tab formed on the second end 50*b* and a fourth indentation 54*b* formed in the housing halves 12, 14. The second tab formed on the second end 50*b* of the second blade carrier 38*b* is moved from third indentation 52*b* to fourth indentation 54*b* (and vice versa) by depressing the second actuating lever 24*b*, which causes the arm second 51*b* to flex, thereby disengaging the second tab formed on the second end 50*b* from the third and fourth indentations 52*b*, 54*b*. Engagement of the second tab formed on the second end 50*b* with the third and fourth indentations 52*b* and 54*b* therefore operates to securely maintain the second blade carrier 38*b* (and hence the second blade 34) in either the retracted or extended position.

Figure 5:
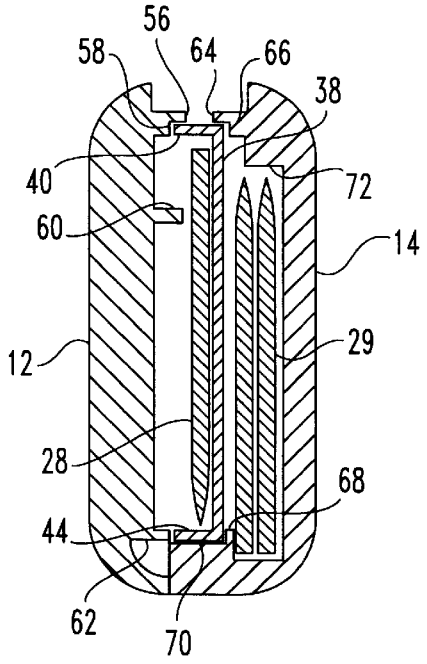
FIG. 5 is a cross-sectional view of the utility knife of the present invention.

Referring now to the cross-sectional view of FIG. 5, it will be appreciated that when the housing halves 12, 14 are coupled together, the blade carrier 38 is maintained within a longitudinal sliding track formed by protrusions 56, 58, 60 and 62 formed integrally with the housing half 12 and by protrusions 64, 66, 68 and 70 formed in the housing half 14. These protrusions from the housing halves 12, 14 form top and bottom C-channel tracks in which the blade carrier 38 runs. It will be appreciated by those skilled in the art that the exact configuration of such tracks is not critical to the present invention, merely that some means for limiting the motion of the blade carrier 38 be provided within the housing halves 12, 14.

As best illustrated in FIG. 5, an indentation 72 is formed in the housing half 14 behind the blade carrier 38 in order to provide a space for storage of spare blades 29. The spare blades 29 may be first blades 28 and/or second blades 34, both of which will fit in this storage space. The spare blades 29 are stored in an inverted position as compared to the blade in the blade carrier 38.

It will be appreciated by those skilled in the art that the utility knife 10 of the present invention exhibits several advantages over prior art utility knives. First, the utility knife 10 allows independent extension and retraction of two blades. This is a particularly desirable feature when two different blades, such as a straight blade and a hooked blade, need to be used repeatedly during the same project. A further advantage of the dual-mechanism of the utility knife 10 is that it allows the cutting surfaces 30, 31 of the two blades 28,34 to be oriented in opposite directions. Such an orientation of the cutting surfaces 30, 31 facilitates single-handed reorientation of the utility knife 10 in the user's hand in order to position the other blade for use. Such reorientation simply involves rotating the knife in the user's hand about an axis extending through the fastener 16. Such a flipping motion is easily accomplished with one hand. When both blades 28, 34 are left in the extended position, the user may easily switch between blades 28,34 by simply rotating the utility knife 10 with a single hand.

By comparison, the prior art double-ended utility knives required that one blade be retracted and the other blade be extended whenever the user desired to switch to the other blade. Furthermore, the cutting surfaces on the prior art double-ended utility knives face in the same direction, thereby making it extremely difficult to reorient the knife for use with the other end without employing both of the user's hands. Another useful feature of the utility knife 10 of the present invention is the provision of a somewhat wider handle than is customary in such knives, with the inclusion of the cavity 72 behind each blade carrying mechanism which allows for the storage of spare blades 29 on both sides of the knife 10. Not only does this increase the number of spare blades 29 which may be carried in the knife 10, it also facilitates carrying spare blades 29 for both types of blades (e.g. a straight blade 28 and a hooked blade 34).

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A double-ended dual-mechanism retractable blade utility knife, comprising:

a housing having a longitudinal axis;

a first blade having a first cutting surface;

a second blade having a second cutting surface;

first blade carrier means for carrying the first blade and for sliding along the longitudinal axis of the housing; and second blade carrier means for carrying the second blade and for sliding along the longitudinal axis of the housing;

wherein the first and second blade carriers slide along the longitudinal axis of the housing independently of one another such that the first and second blades maybe extended in opposite directions;

wherein the first cutting surface of the first blade is positioned on the first side of a longitudinal axis; and wherein the second cutting surface of the second blade is positioned on a second side of the longitudinal axis.

2. The utility knife of claim 1, further comprising:

a first space formed in the housing adjacent the first blade carrier means, the first space sized to allow storage of first spare blades; and a second space formed in the housing adjacent the second blade carrier means, the second space sized to allow storage of second spare blades.

3. The utility knife of claim 1, wherein each of the first and second blade carrier means comprise:

a first portion shaped to engage a blade and to prevent relative movement between the first portion and the blade along the longitudinal axis.

4. The utility knife of claim 3, wherein each of the first and second blade carrier means further comprise:

a flexible arm coupled to the first portion; and a tab formed on a distal end of the flexible arm;

wherein the tab engages indentations in the housing which limit travel of the blade carrier along the longitudinal axis.

5. A double-sided dual mechanism retractable blade utility knife, comprising:

a housing having a longitudinal axis;

a first blade having a first cutting surface;

a second blade having a second cutting surface;

first blade carrier means for carrying the first blade and for sliding along the longitudinal axis of the housing;

a first space formed in the housing adjacent the first blade carrier, the first space sized to allow storage of first spare blades;

second blade carrier means for carrying the second blade and for sliding along the longitudinal axis of the housing; and a second space formed in the housing adjacent the second blade carrier, the second space sized to allow storage of second spare blades;

wherein the first and second blade carriers slide along the longitudinal axis of the housing independently of one another such that the first and second blades may be extended in opposite directions; and wherein a first cutting surface of the first blade is positioned on a first side of the longitudinal axis; and wherein a second cutting surface of the second blade is positioned on a second side of the longitudinal axis.

6. The utility knife of claim 5, wherein each of the first and second blade carrier means comprise:

a first portion shaped to engage the blade and to prevent relative movement between the first portion and the blade along the longitudinal axis.

7. The utility knife of claim 6, wherein each of the first and second blade carrier means further comprise:

a flexible arm coupled to the first portion; and a tab formed on a distal end of the flexible arm;

wherein the tab engages indentations in the housing which limit travel of the blade carrier along the longitudinal axis.

* * * * *